US010077519B2

(12) United States Patent
Travis

(10) Patent No.: US 10,077,519 B2
(45) Date of Patent: Sep. 18, 2018

(54) PANT FABRIC EXPANDING METHOD AND APPARATUS

(76) Inventor: Michael L. Travis, Pleasant Valley, NY (US)

( * ) Notice: Subject to any disclaimer, the term of this patent is extended or adjusted under 35 U.S.C. 154(b) by 816 days.

(21) Appl. No.: 13/110,119

(22) Filed: May 18, 2011

(65) Prior Publication Data

US 2012/0292351 A1 Nov. 22, 2012

(51) Int. Cl.
*D06C 5/00* (2006.01)

(52) U.S. Cl.
CPC ..... *D06C 5/005* (2013.01)

(58) Field of Classification Search
CPC ..... D06C 5/005
USPC ..... 223/52, 61, 63, 66, 67, 72, 74; 446/220, 446/221, 183, 223, 226; 482/83; 434/251; 473/575, 576, 595, 614
See application file for complete search history.

(56) References Cited

U.S. PATENT DOCUMENTS

| | | | | | |
|---|---|---|---|---|---|
| 1,570,508 | A * | 1/1926 | Lungstras | 223/67 |
| 2,074,140 | A * | 3/1937 | Bates | 223/61 |
| 2,948,447 | A * | 8/1960 | Journey et al. | 223/74 |
| 3,202,328 | A * | 8/1965 | Burrell | 223/67 |
| 3,472,434 | A * | 10/1969 | Cherry et al. | 223/67 |
| 3,710,994 | A * | 1/1973 | Cherry et al. | 223/67 |
| 4,593,839 | A * | 6/1986 | Vandoros | 223/63 |
| 5,458,265 | A * | 10/1995 | Hester et al. | 223/72 |
| 5,577,732 | A * | 11/1996 | Spector | 473/576 |
| 5,593,072 | A * | 1/1997 | Hester et al. | 223/120 |
| 7,566,222 | B2 * | 7/2009 | Harkin | 434/267 |
| 2006/0097016 | A1 * | 5/2006 | Nan | 223/67 |
| 2010/0320240 | A1 * | 12/2010 | Sadaoka | 223/67 |

* cited by examiner

*Primary Examiner* — Shaun R Hurley
*Assistant Examiner* — Andrew W Sutton
(74) *Attorney, Agent, or Firm* — Schmeiser, Olsen & Watts, LLP

(57) ABSTRACT

Disclosed herein is an inflatable object including a main body, a first bulge extending from the main body and a second bulge extending from the main body. The inflatable object is receivable within a pair of pants such that the first and second bulges are each configured to expand within a thigh portion of the pair of pants and the main body is configured to expand within a hip portion of the pair of pants. Further, the inflatable object is made of an impermeable, elastic material that is capable of enduring a pressure that will stretch the pair of pants such that the pair of pants retains its stretched dimensions after deflation of the inflatable object. Furthermore, a method for expanding pants is disclosed that includes inserting an inflatable object within a garment, inflating the inflatable object, retaining the inflatable object within the garment, and stretching the garment with the inflatable object such that the garment retains its stretched dimensions after deflation of the inflatable object.

18 Claims, 3 Drawing Sheets

PANT FABRIC EXPANDING METHOD AND APPARATUS

FIELD OF THE TECHNOLOGY

The subject matter disclosed herein relates generally to a method and apparatus to expand pant fabric. More particularly, the subject matter relates to an inflatable object for insertion into the waist section of pants.

BACKGROUND

People wear a variety of different types of pants for a variety of different occasions, such as jeans, khakis, capris, flood pants, overalls, or the like. It may be necessary to replace a pair of pants for various reasons. For example, the pants may be worn out with frays or even holes. Pants may also be outgrown, particularly in the case of a child getting older and bigger. The fabric in pants may also shrink due to machine washing and drying. Adults may also need to replace a pair of pants if they no longer fit because a wearer has gained weight since the time the pants were originally purchased. However, purchasing a new pair of pants, or an entire wardrobe of new pants, may be an expensive and time consuming endeavor. For this reason, a person may choose to wear pants that are uncomfortably tight. Additionally, a person may have a particular favorite pair of pants that they are particularly attached to despite a tight fit. Alternately, the purchase of new pants may be unnecessary if a person intends to lose any weight gained in the near future.

Thus, an apparatus and method for expanding pant fabric at the waist and thighs would be well received in the art.

BRIEF DESCRIPTION OF THE DISCLOSURE

According to one aspect of the invention, an inflatable object comprises a main body; a first bulge extending from the main body; and a second bulge extending from the main body; wherein the inflatable object is receivable within a pair of pants such that the first and second bulges are each configured to expand within a thigh portion of the pair of pants and the main body is configured to expand within a hip portion of the pair of pants; and wherein the inflatable object is made of an impermeable, elastic material that is capable of enduring a pressure that will stretch the pair of pants such that the pair of pants retains its stretched dimensions after deflation of the inflatable object.

According to another aspect of the invention, a method for expanding pants comprises inserting an inflatable object within a garment; inflating the inflatable object; retaining the inflatable object within the garment; and stretching the garment with the inflatable object such that the garment retains its stretched dimensions after deflation of the inflatable object.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Figure 2:
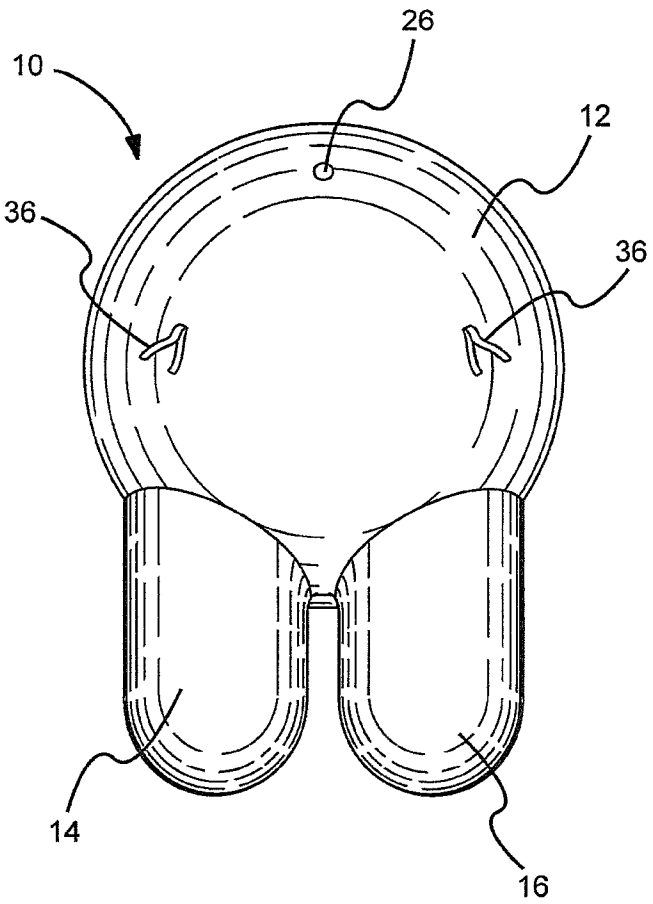
FIG. 2 depicts the inflatable object of FIG. 1 in an inflated state according to one embodiment of the present invention.

A detailed description of the hereinafter described embodiments of the disclosed apparatus and method are presented herein by way of exemplification and not limitation with reference to the Figures.

Referring firstly to FIGS. 1-4, there is shown an inflatable object 10 according to one embodiment of the present disclosure prior to inflation. The inflatable object 10 includes a main body 12 with a first bulge 14 and a second bulge 16 each extending from the main body 12. The inflatable object 10 is receivable within a pair of pants 18 such that such that the first and second bulges 14, 16 are configured to expand within a thigh portion 20 of the pair of pants 18 and the main body 12 is configured to expand within a pelvic portion 22 of the pair of pants 18. The inflatable object 10 may further be made of an impermeable, elastic material, such as Polyvinyl chloride (hereinafter "PVC"). This material may be capable of enduring high pressures that will stretch the pair of pants 18 such that the pair of pants 18 retains its stretched dimensions after deflation of the inflatable object 10. Thus, when a pair of pants 18 becomes too small, or an intended wearer (not shown) becomes too large, the wearer may insert and inflate the inflatable object 10 within the pair of pants 18 such that it exerts enough pressure on the pants 18 to stretch the pants 18 from within. The inflatable object 10 may then be deflated after a period of time, after which the pair of pants 18 may be sufficiently stretched at the hip portion 22 and thigh portions 20 that the pants 18 remain stretched for at least a full day of being worn by the wearer.

Figure 1:
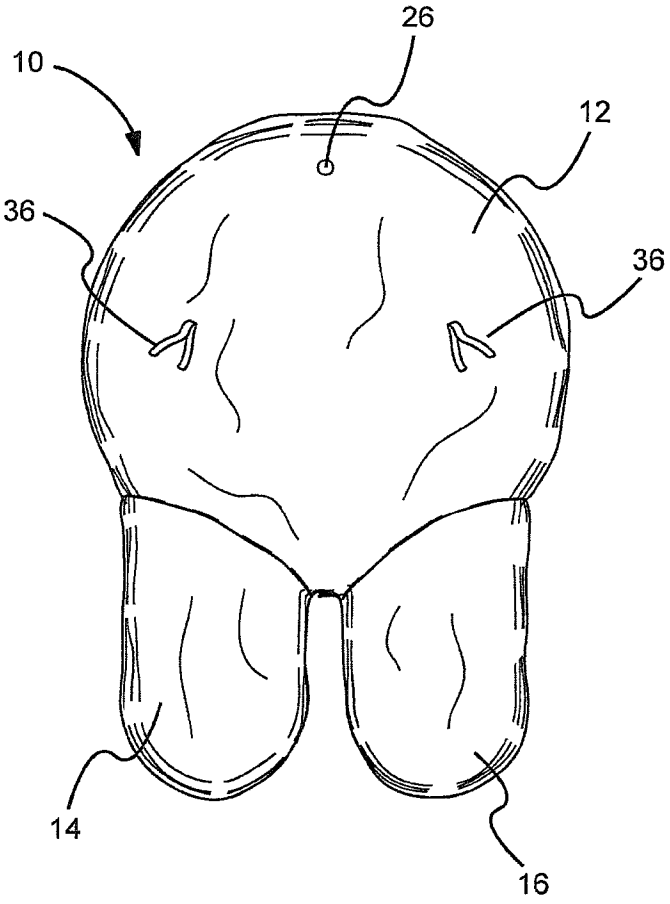
FIG. 1 depicts an inflatable object in a deflated state according to one embodiment of the present invention.

FIG. 1 shows the inflatable object 10 absent the pair of pants 18 and prior to inflation while FIG. 2 shows the inflatable object 10 after being inflated. The main body 12 of the inflatable object 10 is shown substantially spherical in shape. The spherical shape may assist in distributing pressure evenly on the walls of the inflatable object when in an inflated state. The main body 12 is not limited to this shape, however. For example, a more elongated shape is contemplated. Furthermore, the main body 12 may be particularly shaped to fill the pelvic portion 22 of a pair of pants intended to be expanded. It should be understood that the pelvic portion 22 may be referred to as a lower torso or hip portion. The size of the main body 12 is also not limited. The main body 12 may be sized such that, in a maximum inflated state, it is larger than the space within the pelvic portion 22 of the intended pair of pants 18. Thus, when inserted in the intend pair of pants 18, the main body may exert pressure on the hip portion of the pair of pants 18, thereby causing at least semi-permanent stretching. The main body 12 may thus be configured for pants worn by children, smaller adults, or larger adults. Furthermore, because the main body 12 is inflatable, it may still be able to properly expand a child's pair of pants even if the fully inflated size of the main body 12 is very large.

The inflatable object 10 includes two bulges 14, 16, each extending from the main body 12. It should be understood that the bulges 14, 16 may also be referred to as protrusions, extensions, projections, leg portions or the like. The first bulge 14 and the second bulge 16 may be similarly shaped, and may each be configured to expand within a corresponding thigh portion 20 of the pair of pants 18. The length by which the bulges 14, 16 are shown to protrude form the main body 12 may vary. In the embodiment shown in the Figures, the bulges 14, 16 protrude to just above a knee portion of the intended pair of pants 18 to be stretched. In another embodiment, the bulges 14, 16 may extend beyond the knees, if it is intended to stretch the knee portion and a calf portion 24 of the pants 18. It should be understood that the two bulges 14, 16 may stretch each thigh evenly, rather than having only one thigh stretched, as may occur in the case that the inflatable object 10 is spherical and without the bulges 14, 16.

The inflatable object 10 is further shown having an inlet 26 through which air is introduced to inflate the main body 12 and bulges 14, 16. It should be understood that the inlet 26 may also be a nozzle, valve, plug, spigot, tap or the like. The inlet 26 may be receptive on an inflating device (not shown) that may supply air pressure to the inflatable object. The inlet 26 may be receptive of any type of inflating device. For example, the inlet 26 may be receptive of a nozzle or tube element of an inflating device. It should be understood that the inflating device may be a manual air supplying device, such as a manual pump or bellow. Alternately, an automatic air supplying device may be utilized. In the case of an automatic air supplying device, the device may be battery powered or may alternately be plugged into an outlet. It should be understood that the inlet 26 may be receptive of both manual and automatic inflating devices. The inlet may be additionally configured to allow for reception of air directly from a person's mouth.

The inlet 26 may be located antipodal to the bulges 14, 16 on the main body 12, as shown in the Figures. Antipodal herein refers to an antipode, or opposing location on a generally spherical object. However, the inlet 26 is not limited to this location. Any location that is accessible when the inflatable object 10 may be preferable. For example, the inlet 26 may be located at a tip of one of the bulges 14, 16. Furthermore, multiple inlets 26 may be included to provide different options for attaching an inflating device, depending on the garment being stretched.

The inflatable object 10 may also include at least one belt loop attachment mechanism 36. The inflatable object 10 is shown having two belt loop attachment mechanisms 36. However, any number of belt loop attachment mechanisms 36 is contemplated. The belt loop attachment mechanisms 36 may be configured to attach to a belt loop 38 on the pants 18 (shown in FIG. 3). This may help to retain the inflatable object 10 in the proper position during the inflation process. It should be understood that the belt loop attachment mechanisms 16 may be a loop or snap fastener, or may alternately be a hook band and a loop band for creating a loop around the belt loops 38 of the pants 18. Any other attachment means known in the art is also contemplated.

Figure 3:
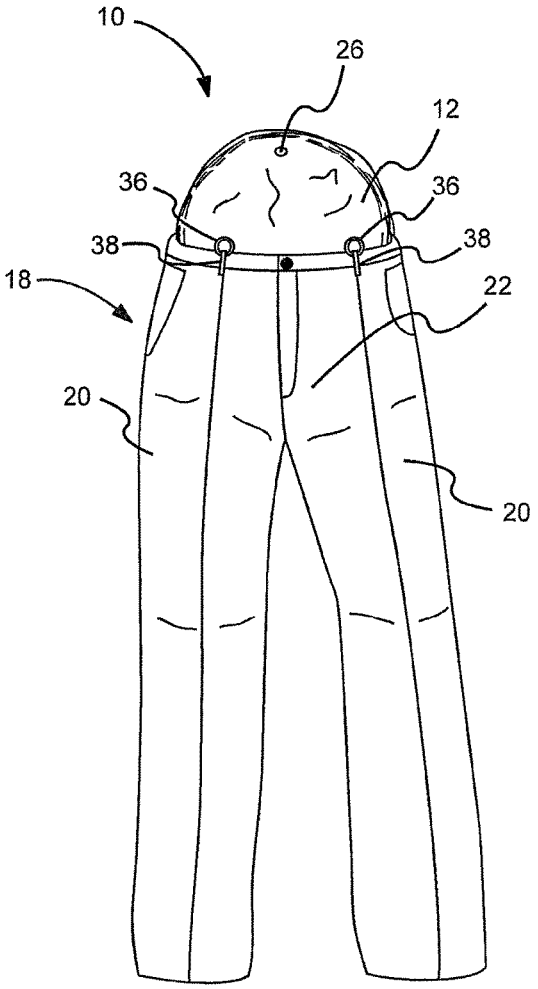
FIG. 3 depicts the inflatable object of FIGS. 1-2 after being received within a pair of pants prior to inflation according to one embodiment of the present invention.
Figure 4:
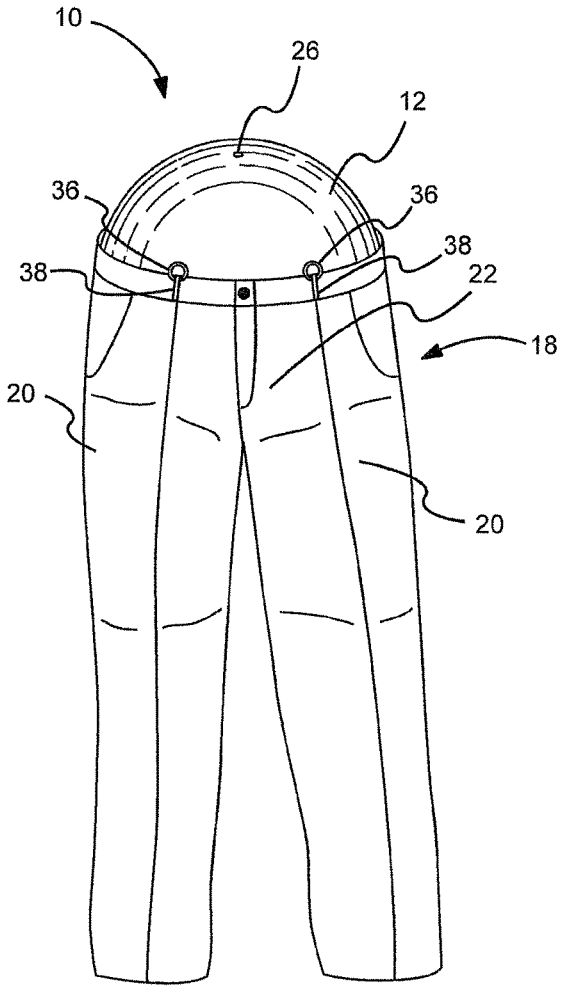
FIG. 4 depicts the inflatable object of FIGS. 1-3 after being received within a pair of pants and after inflation according to one embodiment of the present invention.

FIG. 3 shows the inflatable object 10 inserted into the pair of pants 18 prior to being inflated. In the deflated state the inflatable object 10 fits easily within the pair of pants 18 and may be manually oriented into the position shown. In this position, the main body 12 is located in the pelvic portion 22 while the bulges 14, 16 extend into the thigh portions 20. Once being oriented or situated in this way, the inflatable object 10 may be inflated with the inflating device. FIG. 4 shows the inflatable object 10 inserted into the pair of pants 18 after being inflated such that the inflatable object 10 is stretching the pair of pants. The pair of pants 18 may be retained in this stretched configuration, until the pair of pants 18 is permanently or semi-permanently stretched or expanded at the waist, pelvic portion, and thigh portion.

The main body 12, in combination with the bulges 14, 16, may be particularly shaped depending on the particular style of pants that are intended to be expanded. For example, if the style of pants intended to be expanded is a straight cut pair of jeans, the main bulges 14, 16 may be straight. However, if the pair of jeans is flared, the bulges 14, 16 may also be flared if the bulges 14, 16 extend beyond the knees. A main body and extending bulges are contemplated for any particular style of pant and size. Furthermore, the inflatable object 10 may be configured to expand any type of pants. For example, the inflatable object 10 may be configured to stretch jeans, khakis, capris, flood pants, overalls, or even shorts.

Figure 5:
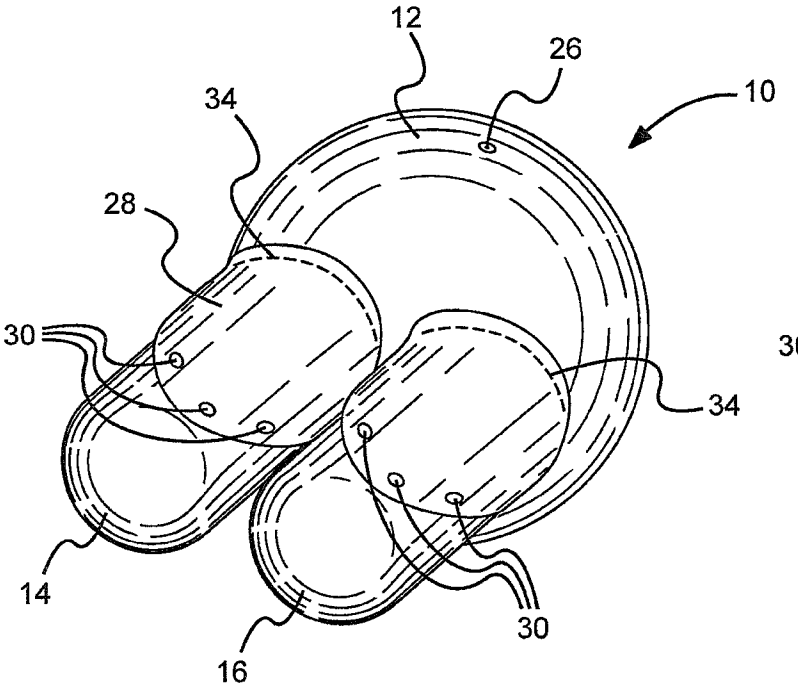
FIG. 5 depicts an inflatable object having two containing flaps attached according to one embodiment of the present invention.

Referring now to FIG. 5, the inflatable object 10 is shown in an inflated state and having two flaps 28 extending from the main body 12 and hanging over the bulges 14, 16. The flaps may be sewn or adhered along an edge 34 of the flaps 28. The flaps 28 may hang from the main body 12 from this edge 34. The flaps 28 have attachment mechanisms 30 that are connectable at attachment locations 32 located on the main body 12 of the inflatable object 10. The attachment mechanisms 30 may be on the opposite side of the flaps 28 than the edge 34. The attachment mechanisms 30 and attachment locations 32 may be buttons, snaps, fasteners, rivets, clamps, couples, joints, pins, or any other fastenening means to secure the flaps 28 to the main body 12.

Figure 6:
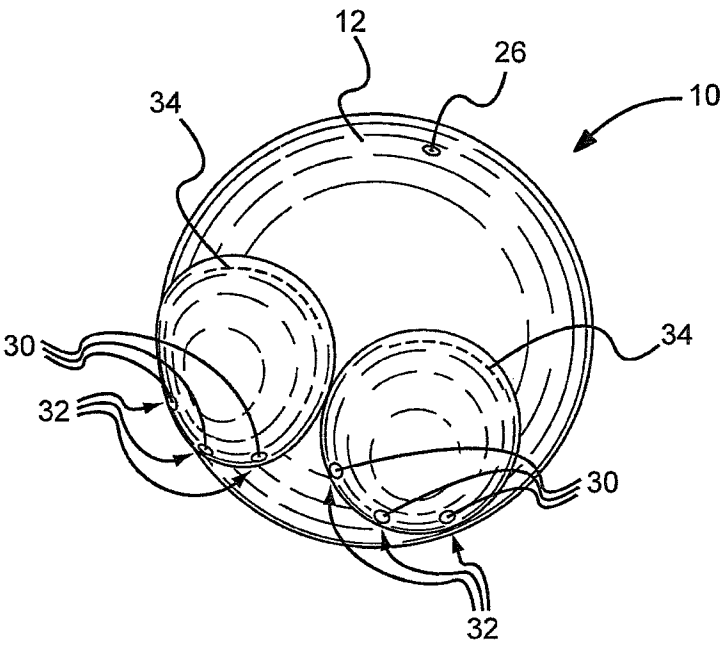
FIG. 6 depicts an expanded view of an attachment location of one of the containing flaps of FIG. 5, according to one embodiment of the present invention.

The flaps 28 may be attached at the attachment locations 32 by the attachment mechanisms 30 prior to inflation of the inflatable object 10. In this embodiment, a user may push the bulges 14, 16 into the main body 12 of the inflatable object prior to inflation. After the flaps 28 have thereafter been attached, the inflatable object 10 may be inflated. FIG. 6 shows the inflatable object 10 in the inflated state having the attachment mechanisms 30 of the flaps 28 attached at the attachment locations 32 of the main body 12. As a result of the flaps 28 containing the bulges 14, 16, the inflatable object 10 may retain a substantially spherical shape. Thus, the inflatable object 10 may be used as a workout or exercise ball. It should be understood that the attachment mechanisms 30 of the flaps 28 may need to be attached to the attachment locations 32 of the main body 12 prior to inflation.

It should also be understood that the inflatable object 10 may not include the bulges 14, 16 in one embodiment. For example, the inflatable object 10 may simply have a spherical or substantially spherical shape. Alternate shapes are also contemplated. For example, the inflatable object may include an oblong cross section to fit within the waist of the pants and extending only to a crotch portion of pants, where the legs meet. In this embodiment, the inflatable object may not include any bulges, or may alternately include very small bulges that do not extend very far down the thigh portion.

Furthermore, the material of the inflatable object 10 may be made from an impermeable, resilient, elastic PVC material. PVC may be particularly ideal because of the Young's modulus of PVC is between 2900-3300 MPa and tensile strength is between 50-80 MPa. However, other materials are contemplated. For example, a rubber, polyethylene, Teflon, polypropylene, or the like. Furthermore, any material having a Young's modulus between 2600-3500 Mpa and a tensile strength between 40-100 MPa may be particularly advantageous. Whatever the material, it should be able to withstand enough pressure to permanently stretch a pair of pants without rupturing, as described hereinabove.

A further embodiment of the disclosure includes a method for expanding a garment, such as the pants 18. The method for expanding pants includes inserting an inflatable object, such as the inflatable object 10, within the garment and inflating the inflatable object. The method further includes retaining the inflatable object within the garment until the pants are stretched such that the pants retain their stretched dimensions after deflation of the inflatable object. This may take a predetermined period of time. The predetermined period may be seconds, minutes or hours. The required duration may depend on the amount of pressure applied and the material of the fabric to be stretched. The method may further include deflating the expandable object and withdrawing the expandable object from the pair of pants. Additionally, the method may include attaching one or more flaps, such as the flaps 28, having attachment mechanisms, such as the attachment mechanisms 30, to attachment locations, such as the attachment locations 32. Still further, the method may include performing exercises with the inflatable object.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

I claim:

1. An inflatable body comprising an inflated shape that conforms to the dimensions of a pelvic portion of a pair of pants, wherein the inflatable body is made of an impermeable, elastic material that is capable of enduring a pressure that will stretch the pair of pants such that the pair of pants retains its stretched dimensions after deflation of the inflatable body, further comprising a spherical main body and a first bulge extending from the spherical main body when the inflatable body is inflated and a second bulge extending from the spherical main body when the inflatable body is inflated, further comprising a first flap and a second flap attached to the main body each having attachment mechanisms for securing the flaps to the main body prior to inflation such that the flaps are configured to prevent the first and second bulges from inflating during inflation under pressure of the inflatable body such that the inflatable body remains at least one of spherical and substantially spherical after inflation under pressure.

2. The inflatable body of claim 1, wherein the first bulge and the second bulge protrude beyond the main body to the knee portion of the pair of pants.

3. The inflatable body of claim 1, wherein the inflatable object is receivable within the pair of pants such that the first and second bulges are each configured to expand within respective thigh portions of the pair of pants.

4. The inflatable body of claim 1, further comprising an inlet located antipodal to the first and second bulges through which air is introducible.

5. The inflatable body of claim 4, wherein the inlet is configured to integrate with an inflating device selected from the group consisting of a manual pump, a manual bellow, and an electronic automatic air supplier.

6. The inflatable body of claim 1, wherein the attachment mechanisms are selected from the group consisting of buttons, snaps, fasteners, rivets, clamps, couples, joints, and pins.

7. The inflatable body of claim 1, wherein the inflatable body is substantially spherical in shape when inflated in an unconfined manner.

8. The inflatable body of claim 1, wherein the inflatable body is shaped like the pelvic and upper thigh region of a person to fill the pelvic portion of the pair of pants when inflated in an unconfined manner.

9. The inflatable body of claim 1, wherein the material has a Young's modulus between 2600 and 3500 MPa and a tensile strength that is between 40-100 MPa.

10. The inflatable body of claim 1, further comprising a belt loop attachment mechanism configured to attach to a belt loop of the pair of pants.

11. The inflatable body of claim 1, wherein the inflatable body is made of Polyvinyl Chloride.

12. A method for expanding a pair of pants comprising:

inserting an inflatable object within a pair of pants, the inflatable object including an inflated shape that conforms to the dimensions of a pelvic portion of the pair of pants, wherein the inflatable body is made of an impermeable, elastic material that is capable of enduring a pressure that will stretch the pair of pants such that the pair of pants retains its stretched dimensions after deflation of the inflatable object, the garment including unstretched dimensions;

inflating the inflatable object while the inflatable object is within the pair of pants;

retaining the inflatable object within the pair of pants; and stretching the pair of pants with the inflatable object under pressure until the unstretched dimensions become stretched dimensions such that the pair of pants retains dimensions greater than the unstretched dimensions after deflation of the inflatable object for at least a day, wherein the stretched dimensions are larger than the unstretched dimensions to a wearer.

13. The method of claim 12, further comprising deflating the inflatable object.

14. The method of claim 13, further comprising withdrawing the inflatable object from the garment.

15. The method of claim 12, further comprising inflating two bulges of the inflatable object such that the two bulges stretch an upper leg region of the garment.

16. The method of claim 12, further comprising attaching a flap having an attachment mechanism to an attachment location to prevent bulges in the inflatable object from inflating.

17. The method of claim 12, further comprising performing exercises with the inflatable object.

18. An inflatable object comprising:

a main body;

a first bulge extending from the main body; and a second bulge extending from the main body;

wherein the inflatable object is receivable within a pair of pants such that the first and second bulges are each configured to expand within a thigh portion of the pair of pants and the main body is configured to expand within a hip portion of the pair of pants; and wherein the inflatable object is made of an impermeable, elastic material that is capable of enduring sufficient pressure so that the inflatable object will stretch the pair of pants such that the pair of pants retains its stretched dimensions after deflation of the inflatable object; and a first flap and a second flap attached to the main body each having attachment mechanisms for securing the flaps to the main body prior to inflation under pressure such that the flaps are configured to prevent the first and second bulges from inflating during inflation under pressure of the inflatable body such that the inflatable body remains at least one of spherical and substantially spherical after inflation under pressure.

* * * * *